United States Patent [19]

Wing

[11] 4,310,159

[45] Jan. 12, 1982

[54] BLOWING GAME INCLUDING ROLLING CYLINDER AND COOPERATING SCORING ZONE

[76] Inventor: Lawrence W. Wing, 3057 Terry St., Walled Lake, Mich. 48088

[21] Appl. No.: 153,026

[22] Filed: May 27, 1980

[51] Int. Cl.[3] ..... A63B 67/14; A63B 67/00

[52] U.S. Cl. ..... 273/108; 273/123 R; 273/85 H

[58] Field of Search ..... 273/118 R, 119 B, 85 H, 273/58 R, 58 K, 123 R, 128 R, 129 AP, 108, 409

[56] References Cited

U.S. PATENT DOCUMENTS

| | | | |
|---|---|---|---|
| 2,620,191 | 12/1952 | Barry | 273/123 R |
| 3,643,951 | 2/1972 | Breslow | 273/108 |
| 3,661,389 | 5/1972 | Harris et al. | 273/409 |
| 3,761,087 | 9/1973 | Meyer | 273/128 A X |
| 4,042,243 | 8/1977 | Hoel et al. | 273/108 |

FOREIGN PATENT DOCUMENTS

| | | | |
|---|---|---|---|
| 1112957 | 10/1954 | France | 273/85 H |
| 14981 | of 1903 | United Kingdom | 273/119 B |
| 498939 | 1/1939 | United Kingdom | 273/108 |

*Primary Examiner*—George J. Marlo

[57] ABSTRACT

A game intended to be played by two players, one at each end of a game board. The game board comprises a flat rectangular playing surface having retaining walls extending upwardly from the sides thereof and a scoring groove in the playing surface parallel to and adjacent each end of the board. The playing piece is a cylindrical member that is rolled on the playing surface by blowing at it. The players score points by blowing the playing piece into the scoring groove at the opponent's end of the board. A score indicating piece is placed in appropriate score indicating notches formed in the board.

10 Claims, 7 Drawing Figures

BLOWING GAME INCLUDING ROLLING CYLINDER AND COOPERATING SCORING ZONE

BRIEF SUMMARY OF THE INVENTION

This invention relates generally to games, and more particularly to a game that also provides health benefits in addition to amusement, wherein the players positioned at opposite ends of a game board attempt to score by blowing at a common cylindrical playing piece to cause it to roll into a groove at the opposite end of the board.

Accordingly, a main object of the invention is to provide a game wherein the players score by blowing from opposite directions at a cylindrical playing piece to propel it to a scoring means.

Another object of the invention is to provide such a game wherein the playing board is a rectangular surface having retaining walls at the sides of the board to retain the playing piece on the board and scoring grooves at the ends of the board to receive the cylindrical playing piece for scoring.

A still further object of the invention is to provide such a game wherein the playing piece is an elongated cylindrical member having a length greater than the width of the scoring grooves and a diameter less than the width of the scoring grooves, whereby the playing piece must be substantially axially aligned with the scoring grooves in order to score.

Another object of the invention is to provide such a game wherein said cylindrical playing piece is formed with convex ends.

Another object of the invention is to provide such a game wherein the scoring groove is rounded so as to enable easy removal of the playing piece from the groove.

A still further object of the invention is to provide such a game having score indicating means formed integrally with the game board.

Still another object of the invention is to provide such a game wherein the junctures of the playing surface and the retaining walls are curved or radiused so that the cylindrical playing piece is less likely to become trapped therein at such juncture, as it might if the juncture were not radiused.

These and other objects and advantages of the invention will become more apparent by reference to the following specification and the appended drawings.

DETAILED DESCRIPTION

Figure 1:
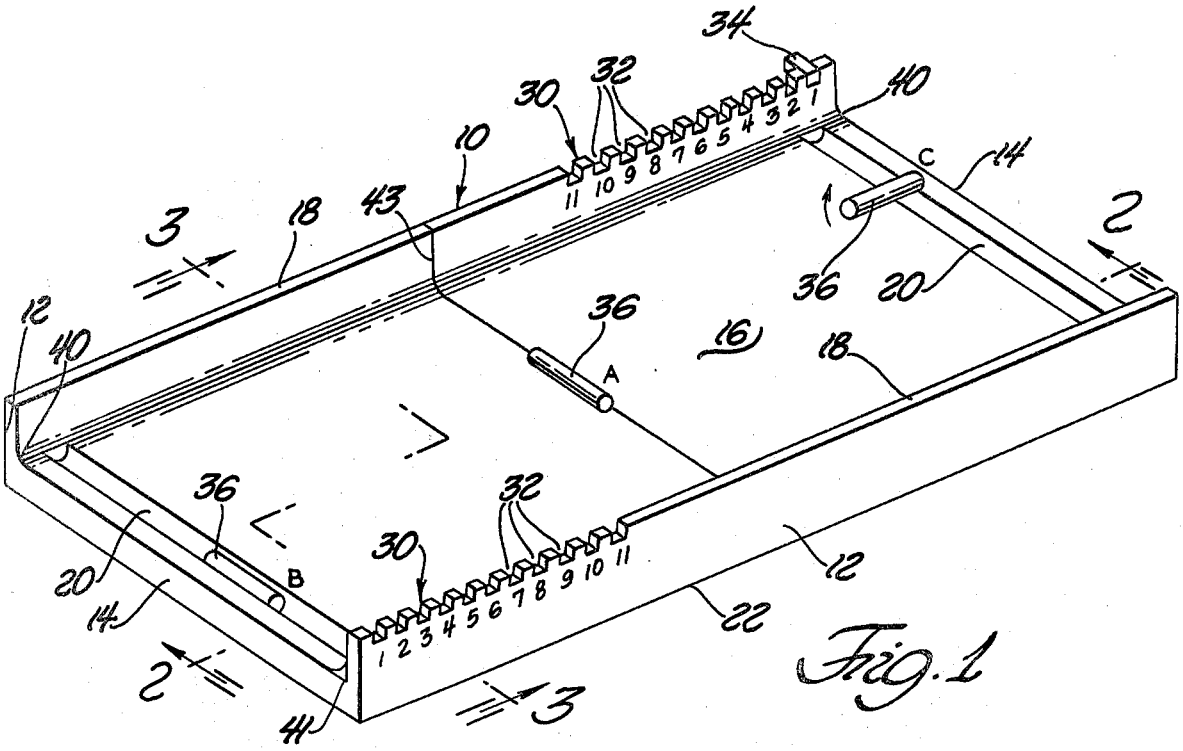
FIG. 1 is a perspective view of a game, including a game board with score indicating means, a playing piece and a scoring indicating piece, for a game embodying the invention.

Reference is now made to the drawings, which are for purposes of illustration only, and wherein like elements are identified by the same or like reference numerals.

Figure 2:
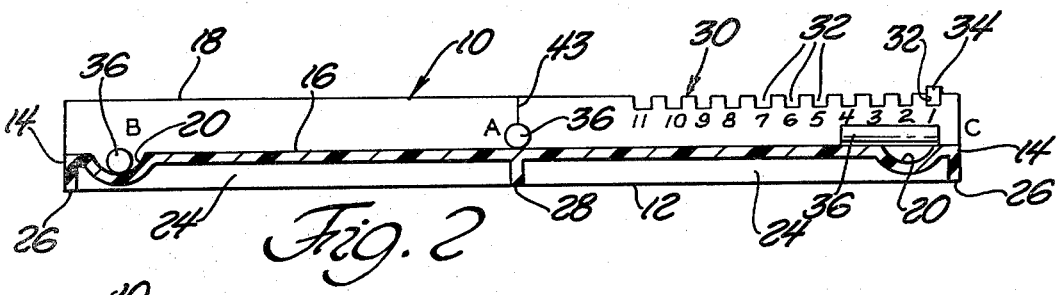
FIG. 2 is a cross-sectional view taken on the plane of line 2—2 of FIG. 1, looking in the direction of the arrows.
Figure 3:
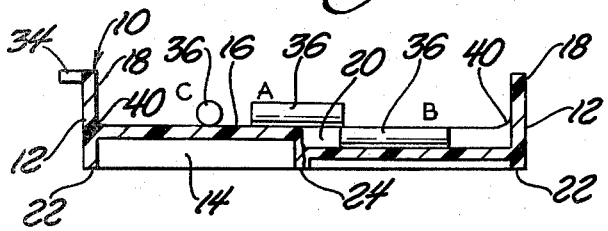
FIG. 3 is a cross-sectional view taken on the plane of line 3—3 of FIG. 1, looking in the direction of the arrows.

Referring specifically and in detail to FIGS. 1–3, a game embodying the invention includes a game board 10, which may be formed in any desired manner and from any suitable materials. In the drawings, for example, the one-piece board 10, as well as the playing and scoring pieces, are shown as being made from molded plastics.

In any event, the board 10 is preferably generally rectangular, and, while the dimensions thereof may vary, it has been found that a board having a side 12 length (FIG. 2) of twenty-four inches (24″) and an end 14 width (FIG. 3) of twelve inches (12″) is satisfactory game board size for two players. If desired, the board 10 may be made somewhat shorter or longer and/or wider, depending upon factors such as the age group for which the board is intended, whether it is intended for singles (2 players) or doubles (4 players) games, as in tennis, and the like.

It will be seen, in FIGS. 1–3, that a plastic molding technique has been employed in manufacture of the board 10, to reduce the weight thereof and the amount of material required. That is, the board 10 shown is formed to provide a preferably flat playing surface 16, the side retaining means provided by the upstanding walls 18 extending upwardly from the playing surface 16 along the sides 12 and a scoring groove 20 at each end 14. It is noted that the grooves 20 are disposed adjacent and parallel to the ends 14, and that they extend between and preferably (but not necessarily) right up to the retaining walls 18.

While the size (width) of the grooves 20 may be varied, it has been found that half-round grooves of three-quarter inch ($\frac{3}{4}$″) diameter are suitable, which would result in the grooves extending $\frac{3}{8}$″ below the playing surface 16. If the playing surface were solid material from top to bottom, for example, it would have to be about $\frac{1}{2}$″ thick to accommodate $\frac{3}{8}$″ deep grooves 20. However, the injection molding dies can be formed so as to provide a game board 10 having a thinner playing surface 16 having grooves 20 and supported by side and intermediate lengthwise ribs 22 and 24, respectively, and end and intermediate cross ribs 26 and 28, respectively.

With the above described molded construction, the maximum material thickness may be on the order of $\frac{1}{8}$″, for example. Also, the plastic material may be either the hard and rigid type or the softer and pliable type, the latter being perhaps more desirable for players of younger age groups.

As stated, the drawings are only illustrative. That is, it is apparent that the game board 10 could also be otherwise made of other materials, such as stamped metal or an assembly of wood parts. However, injected plastic molding seems preferable for various additional reasons.

For example, for reasons to be explained by reference to FIG. 4, it may be desirable to form the juncture of the retaining walls 18 and the playing surface 16 so as to be rounded. Also, the score indicating means 30, which comprises a series of appropriately numbered notches 32 adapted to receive a separate scoring piece or marker 34, may be more conveniently formed by plastic molding.

Figure 5:
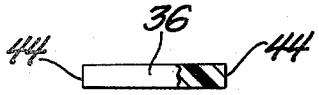
FIG. 5 is a side elevational view, with a portion thereof broken away and in cross-section, of the playing piece shown in FIG. 1.

It has also been found that the playing piece 36 is preferably a ⅜" round dowel about 2" long. It may be molded from a plastic material, as shown in FIG. 5, or it may be made of some other material such as wood. As will be explained, the dowel 36 is cylindrical so that it can easily be caused to roll on the playing surface 16 by the players' blowing at the dowel with their mouths. Forming the playing piece as a cylindrical dowel (rather than as a ball, for example) is a unique feature that results in a greater possible propelling force because of the larger area available on a dowel to be acted upon by the player's breath. Also, as will be explained, scoring requires axial alignment of the dowel 36 with groove 20, which, in turn, requires the additional directional capability (the player can blow at one end or the other of the dowel) of the elongated playing piece, as compared to a ball.

That is, the elongated dowel and groove playing piece and scoring means provide a game that is uniquely suitable to be played by lower age groups. As stated, the dowel requires the directional alignment. However, if a ball were used as the playing piece, then the dowel 36 can also represent a ball, as shown by the end views thereof in FIGS. 2–4.

Figure 4:
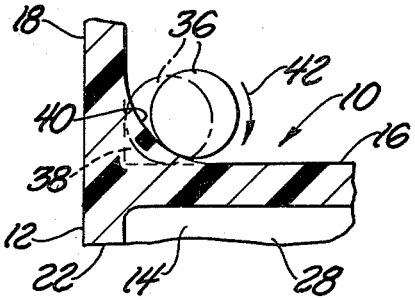
FIG. 4 is an enlarged fragmentary of a portion of FIG. 3 illustrating a feature of the invention.

Referring now specifically to FIG. 4, which is a fragmentary portion of the left-hand side of FIG. 3, the dotted line structure illustrates a dowel 36 wedged or trapped lengthwise in the right angle corner 38 between a straight vertical wall 18 and flat horizontal playing surface 16. If that were to occur during a game, it would be very difficult, if not impossible, even for an adult, to dislodge the wedged dowel 36 by blowing on it. That is, chances are that the game would have to be stopped and the dowel repositioned by hand, somewhat like the puck is dropped by the referee after icing, etc., in the game of hockey.

If such trapping of the dowel is desired, then, of course, the right angle corner 38 can be provided, at some portion or along the entire length of board 10. However, if it is desired to limit or prevent such trapping of dowel 36 and interruption of the game, then a substantially rounded juncture 40 can be provided, by molding or by a separate piece 41, if desired (FIG. 1). With the curved surface 40, as suggested by the arrow 42, the dowel 36 cannot become lodged in a corner since it will merely roll down the curved surface 40 to the playing surface 16 by gravity.

A transverse centerline 43, which may be merely a very slightly raised or grooved line, is preferably formed on the board 10 for a purpose to be described.

GAME AND OPERATION OF BOARD APPARATUS

A possible name for a game embodying the invention might be "BLOW HARD", the appropriateness of such a name being evident from the description below.

To play the game, two players place the board 10 between them on a support such as a table or the floor. The players may, if desired, place their hands on the side rails or retaining walls 18. One player then places the dowel 36 on the centerline 43 of the game board 10, as shown at A in FIGS. 1–3.

Then, one of the players says "GO!", at which time the players start blowing at the dowel 36, the object of each player being to blow the playing piece 36 into the groove 20 at the opponent's end of the board 10, as depicted at B of FIGS. 1–3. No point is scored if the playing piece 36 merely extends over the groove 20, as shown at C. Also, if the playing piece 36 goes off the board 10, no point is scored, and the game must be started over. To score a point, the playing piece 36 must be blown into a groove, as at B.

When the playing piece 36 is blown into a groove, the scoring player places his score indicating piece 34 into the appropriate numbered notch 32 to indicate his score. The game is completed, for example, when one player scores 11 points.

Obviously, the instructions or rules for a game embodying the invention may provide for many variations as to how the game may be played. The explanation given above is very general, to explain generally the use of the game board and the playing and scoring pieces.

Figure 6:
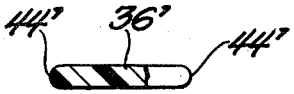
FIG. 6 is a side elevational view, with a portion thereof broken away and in cross-section, of a modified playing piece.
Figure 7:
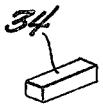
FIG. 7 is a perspective view of the scoring piece shown in FIGS. 1–3.

Also, structural variations in the game board 10 and in the score indicating and playing pieces 34 and 36 are possible, as already referred to above. A further modification is shown in FIG. 6, wherein the playing piece 36' is formed with convex ends 44', as contrasted from the flat ends 44 of playing piece 36 of FIG. 5. Such convex ends 44', especially when used on a board 10 having the curved surface 40, further tend to prevent trapping of the piece 36' and make the game more lively.

It is noted that in the preferred embodiment of the game board, the retaining walls are formed only at the sides and not at the ends thereof. This is so the players can blow more nearly parallel to the playing surface without interference by a wall. That is, a retaining wall adjacent the scoring groove would not permit blowing parallel to the surface; rather, the player would have to blow at the playing piece at an angle to the playing surface, thus reducing the maximum propelling force that can be directed at the playing piece.

While specific preferred embodiments of the invention have been shown and described, it is to be understood that these are representative only, and no limitations are intended, except as recited in the appended claims.

What I claim as my invention is:

1. A game wherein opposing players roll a cylindrical playing piece into scoring position by blowing at it with their breath, said game comprising a game board and at least one cylindrical playing piece, said board comprising a base having oppositely disposed sides and oppositely disposed ends, retaining means associated only with said sides and scoring means associated only with said ends, said playing piece being formed so as to cooperate with said scoring means.

2. A game such as that recited in claim 1, wherein said retaining means comprises a wall extending upwardly for each of said sides.

3. A game such as that receited in claim 2, wherein said board includes score indicating means and said score indicating means comprising transverse scoring notches formed in the top of said retaining walls and a score indicating piece adapted to be positioned in the appropriate notch.

4. A game such as that recited in claim 3, wherein transverse centerline indicating means is formed on said board, one of said score indicating means being formed on each side of said centerline.

5. A game such as that recited in claim 1, wherein said scoring means comprises a groove at and parallel to each end of said board each of said grooves extending substantially from one of said sides to the other side.

6. A game such as that recited in claim 5, wherein said playing piece is an alongated cylindrical member adapted to be received lengthwise in said groove the diameter of said cylindrical playing piece being less than the width of said scoring grooves.

7. A game such as that recited in claim 6, wherein the length of said cylindrical playing piece is greater than the width of said scoring grooves, whereby said playing piece cannot be received in said scoring groove to score unless said playing piece is positioned parallel to one of said grooves.

8. A game such as that recited in claim 7, wherein said playing piece is an elongated cylindrical member having convex ends.

9. A game in which the players score by using their breath to blow a playing piece into scoring position, said game including a game board and a playing piece, said game board comprising a generally rectangular base adapted to be positioned generally horizontally and having generally parallel opposite sides and generally parallel opposite ends, a retaining wall extending upwardly from said horizontal base at and along substantially the full length of each of said sides, said ends being substantially free of such retaining walls, scoring means formed at each of said ends, each of said scoring means comprising a groove formed in said base, said groove extending between and substantially to each of said side retaining walls, and transverse centerline indicating means formed on said game board, the distances between said centerline and said grooves being equal, said playing piece comprising a cylindrical element adapted to be rolled on said base by blowing thereon and to be received lengthwise in said grooves, the diameter of said cylindrical playing piece being less than the widths of said grooves and the length of said playing piece being greater than the widths of said grooves, said game being played, for example, after placing said cylindrical playing piece on said transverse centerline of said base, by one player at each end of said base simultaneously blowing at said playing piece and thereby attempting to roll said piece into the scoring groove at the opponent's end of said base, the relative configurations and dimensions of said scoring grooves and said playing piece being such that scoring can occur only when said playing piece is substantially parallel to one of said scoring grooves and not when said piece is not parallel thereto.

10. A game such as that recited in claim 9, wherein the absence of end retaining walls enables said playing piece to be rolled off said base at the ends thereof when said piece is not parallel to said scoring groove.

* * * * *